US012474059B2

(12) United States Patent
Gross

(10) Patent No.: US 12,474,059 B2
(45) Date of Patent: Nov. 18, 2025

(54) LOG-LIKE BLOCK FOR A GAS BURNER AND A METHOD FOR PRODUCING THE SAME

(71) Applicant: ORTAL—HEATING & AIR CONDITIONING SYSTEMS LTD., Hod Hasharon (IL)

(72) Inventor: Benjamin-Tal Gross, Hod Hasharon (IL)

(73) Assignee: ORTAL—HEATING & AIR CONDITIONING SYSTEMS LTD., Hod Hasharon (IL)

( * ) Notice: Subject to any disclaimer, the term of this patent is extended or adjusted under 35 U.S.C. 154(b) by 712 days.

(21) Appl. No.: 17/864,904

(22) Filed: Jul. 14, 2022

(65) Prior Publication Data

US 2022/0349583 A1 Nov. 3, 2022

Related U.S. Application Data

(63) Continuation-in-part of application No. 16/752,921, filed on Jan. 27, 2020, now abandoned.

(60) Provisional application No. 62/797,279, filed on Jan. 27, 2019.

(51) Int. Cl.
*F24C 3/00* (2006.01)

(52) U.S. Cl.
CPC ..... *F24C 3/006* (2013.01)

(58) Field of Classification Search
CPC ..... F24C 3/006; F24B 1/1808; F23D 14/46; F23D 2900/14003; F23D 2900/14041; F23D 14/10; F23D 14/48; F23D 2203/1012
See application file for complete search history.

(56) References Cited

U.S. PATENT DOCUMENTS 1,106,914 A * 8/1914 Bartlett et al. ..... F23D 11/10 239/587.2
1,618,477 A 2/1927 Sala
2,887,741 A * 5/1959 Sabel ..... B22C 13/08 164/192
2,962,091 A * 11/1960 Sabel ..... F23D 14/10 239/602

(Continued)

FOREIGN PATENT DOCUMENTS

BE 770101 A 12/1971
BE 1020195 A3 6/2013

(Continued)

*Primary Examiner* — Jorge A Pereiro
(74) *Attorney, Agent, or Firm* — Ballard Spahr LLP

(57) ABSTRACT

A log-like block for a gas burner is provided. The block having a pipe with a distal part at least partially made of flexible material and associated with at least one distal end of the pipe, and a pipe proximal part associated with a proximal end of the pipe. The block further includes a passage with shape and dimensions corresponding to those of the distal part. The distal part being built-in the passage so that the distal end is closed therein and the distal part is incapable of being moved relative to the passage. The proximal part being configured to be brought into gas communication with a gas supply source. The block further comprises a pipe outlet opening formed in the pipe distal part, exposed to an exterior of the block so as to allow gas to exit the pipe through the opening.

7 Claims, 4 Drawing Sheets

(56) References Cited

U.S. PATENT DOCUMENTS

| | | | | | |
|---|---|---|---|---|---|
| 3,113,611 | A | | 12/1963 | Dupler | |
| 3,133,588 | A | * | 5/1964 | Pappas | F23D 14/46 239/602 |
| RE25,987 | E | | 3/1966 | Dupler | |
| 3,359,401 | A | * | 12/1967 | Pappas | F23D 14/04 73/304 R |
| 3,871,355 | A | * | 3/1975 | Henry | F24C 3/006 126/92 R |
| 3,905,756 | A | * | 9/1975 | Ferlin | F23D 14/64 431/354 |
| 4,118,175 | A | * | 10/1978 | Riehl | F23D 14/105 431/354 |
| 4,418,456 | A | | 12/1983 | Riehl | |
| 4,762,530 | A | * | 8/1988 | Koziol | A47J 37/0713 126/41 R |
| 4,828,485 | A | | 5/1989 | Jankowski | |
| 5,496,384 | A | | 3/1996 | Jeskey et al. | |
| 5,655,513 | A | | 8/1997 | Whitfield | |
| 6,000,934 | A | * | 12/1999 | Shavers | F23D 14/10 239/590.5 |
| 6,006,743 | A | | 12/1999 | Shimek et al. | |
| 6,048,195 | A | | 4/2000 | Shimek et al. | |
| 6,095,794 | A | * | 8/2000 | Jamieson | F23D 14/10 431/354 |
| 6,155,249 | A | | 12/2000 | Gregory | |
| 6,383,421 | B1 | | 5/2002 | Phipps | |
| 7,146,975 | B1 | | 12/2006 | MacPherson | |
| 8,336,534 | B2 | * | 12/2012 | Irvin | F23D 14/105 126/41 R |
| 2002/0072024 | A1 | | 6/2002 | Butler et al. | |
| 2003/0039933 | A1 | | 2/2003 | Lyons et al. | |
| 2004/0031479 | A1 | * | 2/2004 | Davis | F23D 14/28 126/41 R |
| 2010/0151398 | A1 | | 6/2010 | Smith | |

FOREIGN PATENT DOCUMENTS

| | | | | |
|---|---|---|---|---|
| CN | 208124286 | U | * | 11/2018 |
| FR | 2629178 | A1 | * | 9/1989 |
| NL | 2005264 | C2 | * | 2/2012 |
| WO | 0150064 | A1 | | 7/2001 |

* cited by examiner

LOG-LIKE BLOCK FOR A GAS BURNER AND A METHOD FOR PRODUCING THE SAME

TECHNICAL FIELD

The presently disclosed subject matter relates to log-like blocks made of a heat resistant material, for use with a gas burner, which in association with a gas flame creates an illusion of a log fire.

BACKGROUND

It is known that in a gas burner comprising at least one rigid pipe configured to produce gas flame coming out of its openings, log-like blocks are disposed relative to such pipe so as to create an illusion of a log fire.

WO01/50064 discloses one example of such gas burner, in which a log-like block is configured to lie on the pipe so that flames coming out of the pipe openings curl around the block facilitating the above illusion.

Similar solutions have been implemented by companies M-design and Bellfire and at least one of them seems to have attempted to produce a log-like block by first producing a log body with a channel, which is substantially straight, then inserting thereinto a rigid pipe having openings, and providing passages in the block body to expose the openings to the exterior of the pipe.

GENERAL DESCRIPTION

According to one aspect of the presently disclosed subject matter, there is provided a log-like block comprising:

a pipe having a pipe distal part made at least in part of a flexible material and associated with at least one distal end of the pipe, and a pipe proximal part associated with a proximal end of the pipe;

a block body having a passage with a passage shape and dimensions corresponding to those of the pipe distal part, the pipe distal part being built-in in the passage so that the at least one pipe distal end is closed therein and the pipe distal part is free of a capability of being moved relative to the passage, the pipe proximal part with the proximal end of the pipe being configured to be brought into a gas communication with a gas supply source; and at least one pipe outlet opening formed in the pipe distal part, optionally in its portion made of a flexible material, and exposed to an exterior of the block so as to allow a gas within the pipe to exit the pipe distal part through the opening.

Due to the above construction of the above log-like block, its manufacturing can be facilitated irrespective of the shape of the body and configuration of the pipe therein, by producing the block body on and around at least a portion of the pipe. The log-like block can thus be molded or extruded around at least the pipe distal part.

According to another aspect of the presently disclosed subject matter, there is provided a method for producing a log-like block, the method comprises at least the following steps:

(a) providing a pipe having at least one first end intended to constitute a pipe distal end and a second end intended to constitute a pipe proximal end;

(b) providing a material which is configured to rigidify from a first non-rigidified state into a second rigidified state;

(c) surrounding a distal part of the pipe comprising the at least one pipe distal end by said material in the first state within a mold so as to allow the remainder of the pipe with the pipe proximal end to be brought via the pipe proximal end into a gas communication with gas supply source;

(d) allowing the material within the mold to rigidify into the block body so that the pipe distal part surrounded thereby appears to be built-in in the block body, being disposed in a passage within the block body, and being free of a capability of being moved relative to the block body and so that the at least one pipe distal end is closed therein, the block body together with the pipe distal part being built-in therein constituting the log-like block;

(e) removing the log-like block from the mold; and (f) providing fluid communication through the block body between an opening in the pipe distal part and an exterior of the block so as to allow a gas within the pipe to exit the pipe distal part through the opening.

The mold used in the above method can comprise a number of mold portions configured to be assembled with each other at least in step (c) above. Alternatively, the block body can be produced from two pre-fabricated block body portions configured to be integrally assembled, each having a passage portion, the passage portions of the two block body portions being configured to define a passage in which a pipe distal part with at least one pipe distal end is introduced during the process of assembling the block body, the pipe and the passage having such shape and dimensions as to ensure that the pipe distal part is built-in in the passage so that the at least one pipe distal end is closed therein and the pipe distal part is free of a capability of being moved relative to the passage, the remainder of the part being configured to be brought into a gas communication with a gas supply source.

In both of the above aspects of the presently disclosed subject matter, the appearance of the log-like block can be that of a natural wood log and it can have one or more features described below.

With the above structure and/or production method, the block body and/or the passage therein, or at least a part of any of them, can have any desired shape, e.g. can be of an elongated shape, extending mainly along a straight axis or mainly along a curved axis, or can have parts extending along such different axes. Consequently, in operation, the log-like block's performance can be achieved which is close in its appearance as that of the natural wood log.

Furthermore, with the above built-in configuration of the pipe within the block body, its ability to be moved relative to the block body, is practically eliminated, with the pipe distal ends and being closed therein, thereby inter alia allowing to avoid any risk that during the formation of the pipe outlet opening/s as described above, the pipe will be moved relative to the block body.

With the pipe having a circumferential surface and the passage having an inner surface, the latter surface can be in intimate contact with the entire circumferential surface of at least the pipe distal part.

The pipe distal part can have at least a portion which is not straight, the portion can be made of a flexible material, and the passage can have a corresponding non-straight portion. The pipe distal part can have at least one rigid portion adjacent to at least one flexible portion. The rigid portion can be disposed between at least two flexible portions of the pipe.

The pipe proximal part can be made of the same or different material as the pipe distal part, and it can be rigid or flexible.

The block body can have at least one elongated groove formed therein so as to allow the exposure therethrough of the pipe outlet opening to the exterior of the block. The log-like block can further comprise metal wool placed within the groove at least at one location thereof.

The pipe distal part can have a pipe main portion and at least one pipe branch portion extending transversely thereto, and the passage can have a passage main portion and at least one passage branch portion corresponding in shape and dimensions to, and receiving, the pipe main and branch portions, respectively.

The block body can be made of a heat resistant material such as ceramic material, ceramic fiber, concrete or the like.

The log-like block can constitute a part of a gas burner comprising a gas supply conduit configured to receive therein at least the proximal end of the pipe proximal part.

The gas burner can further comprise a holder configured to detachably hold the log-like block in a desired orientation in an interior of the fireplace, the holder comprising a gas outlet port configured to receive therein the proximal end of the pipe.

The gas burner can further comprise fixation means configured to fix the holder to the interior of the fireplace. The orientation, in which the holder holds the log-like block, can be adjustable at least during installation of the gas burner.

The gas burner can further comprise an aeration chamber disposed within the holder, and configured to be brought in gas communication with the gas source to allow gas flow into the combustion chamber and with the interior of the fireplace to allow access of air to the chamber for aeration of the gas, and optionally an air input valve configured for adjusting the amount of air accessing the aeration chamber.

In the above method for producing a log-like block within the mold, the mold can have such a shape that the block body is formed with at least one elongated groove having a configuration similar to that, and aligned with, the pipe distal part, and wherein the step of forming the openings is performed through the groove. The method can further comprise a step of placing a metal wool within the groove.

BRIEF DESCRIPTION OF THE DRAWINGS

The foregoing and other features and advantages of the presently disclosed subject matter will be more fully understood from the following descriptions of various embodiments of the presently disclosed subject matter and the accompanying drawings. In the drawings like reference numerals generally refer to similar elements throughout. The drawings are not necessarily to scale, emphasis instead being placed upon illustrating the principles of the presently disclosed subject matter.

DETAILED DESCRIPTION OF EMBODIMENTS

Figure 3:
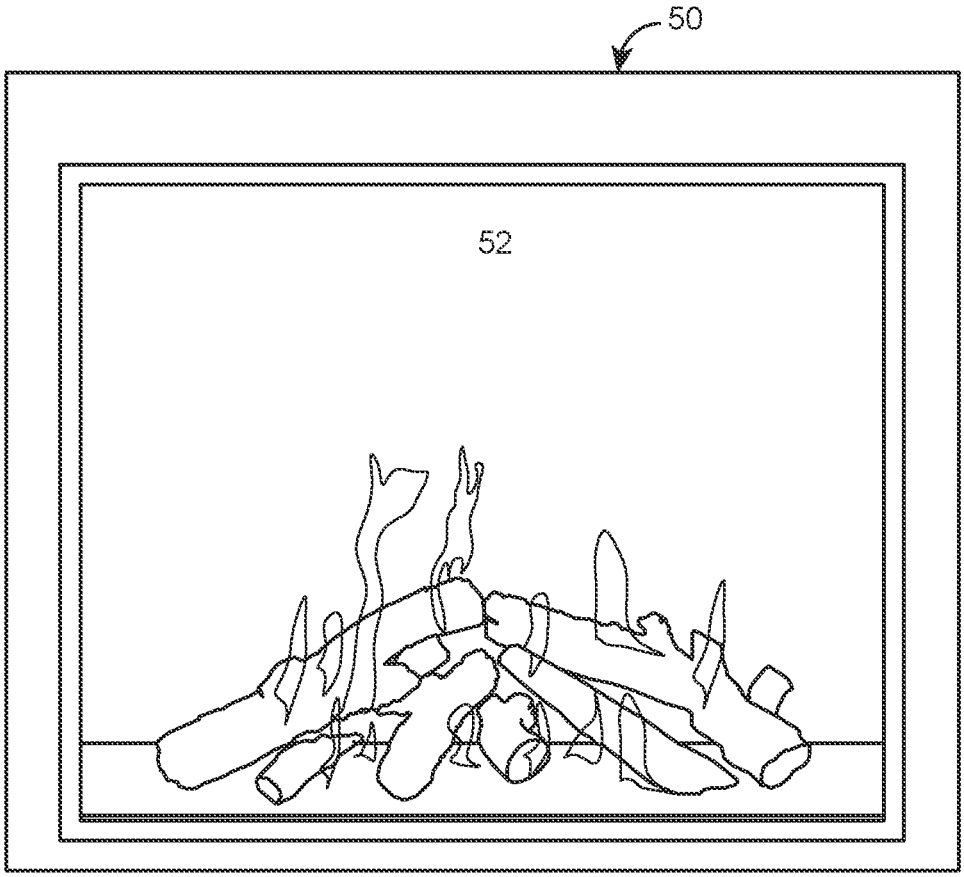
FIG. 3 is a schematic front view of a fireplace with log-like blocks, at least one of which can be in the form of a log-like block according to the presently disclosed subject matter.

FIG. 1A to 1D, illustrate one example of a log-like block 1 of the presently disclosed subject matter. Though the description presented below with reference to FIGS. 1A to 1D is in relation to the construction of the log-like block 1 shown therein, it is fully applicable to other blocks in accordance with the present presently disclosed subject matter, which can have any desired shape and dimensions, and can be used in any desired number in any suitable gas burner e.g. such as shown in FIG. 3.

Figure 1A:
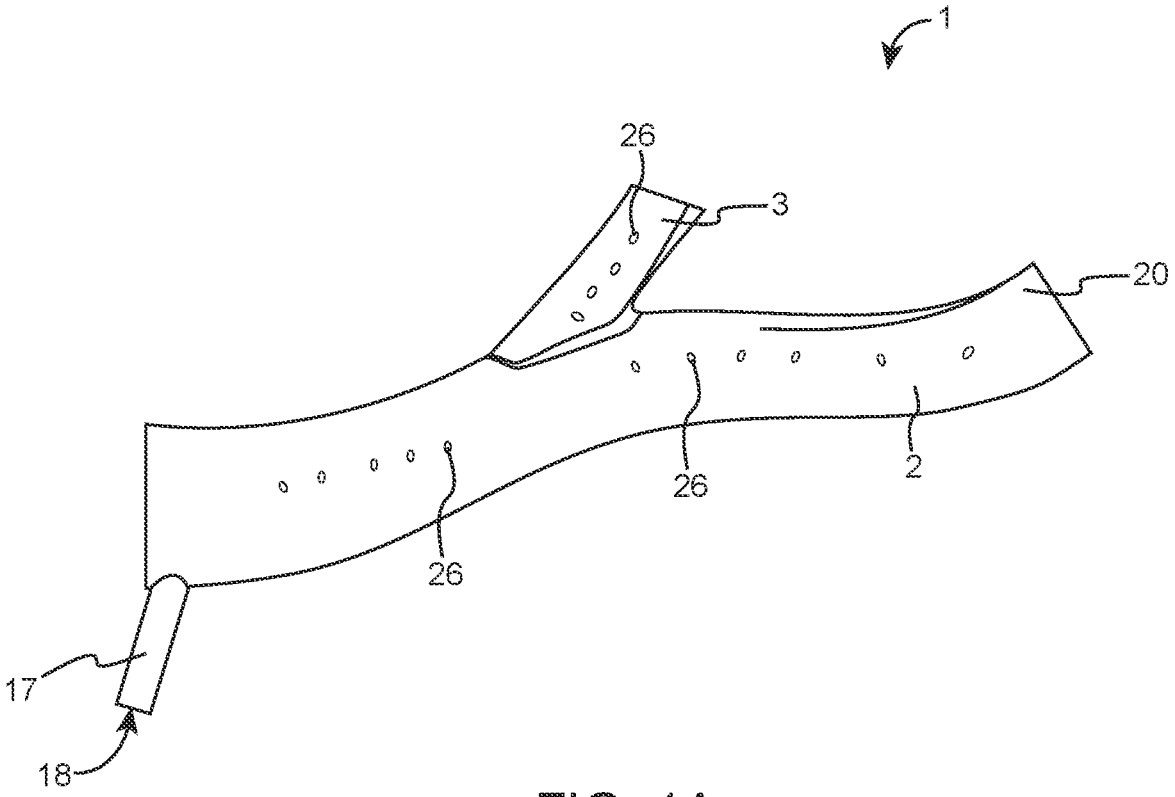
FIG. 1A is a schematic plan view of a log-like block, according to one example of the presently disclosed subject matter.
Figure 1B:
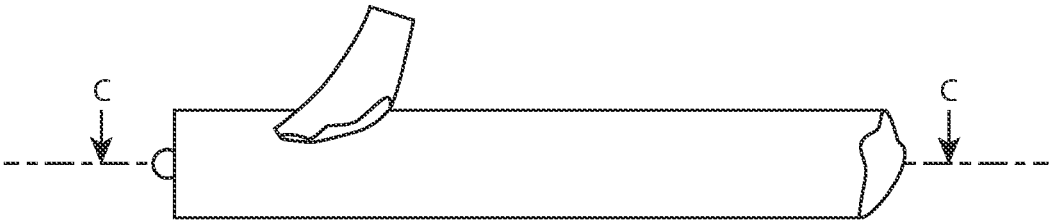
FIG. 1B is a schematic side view of the log-like block shown in FIG. 1A.

With reference to FIG. 1A, the log-like block 1 comprises a block body 20 having a generally elongated shape and having a textured surface providing to the log-like block 1 a desired appearance and texture. In the present example, the appearance is of a natural wood log. The block body 20 can be made of any heat resistant, non-combustible material allowing producing the block body with the above mentioned appearance and texture.

In the present example, the log-like block 1 comprises a main portion 2 and a branch portion 3 extending transversely from the main portion 2. Whilst the log-like block 1 is shown with a single branch portion, log-like blocks of the presently disclosed subject matter can have multiple branch portions 3 extending from the main portion 2 of the block body 20 as per different designs of the log-like block 1. Alternatively, log-like blocks of the presently disclosed subject matter can comprise only the main portion 2 and have no branches.

Figure 1C:
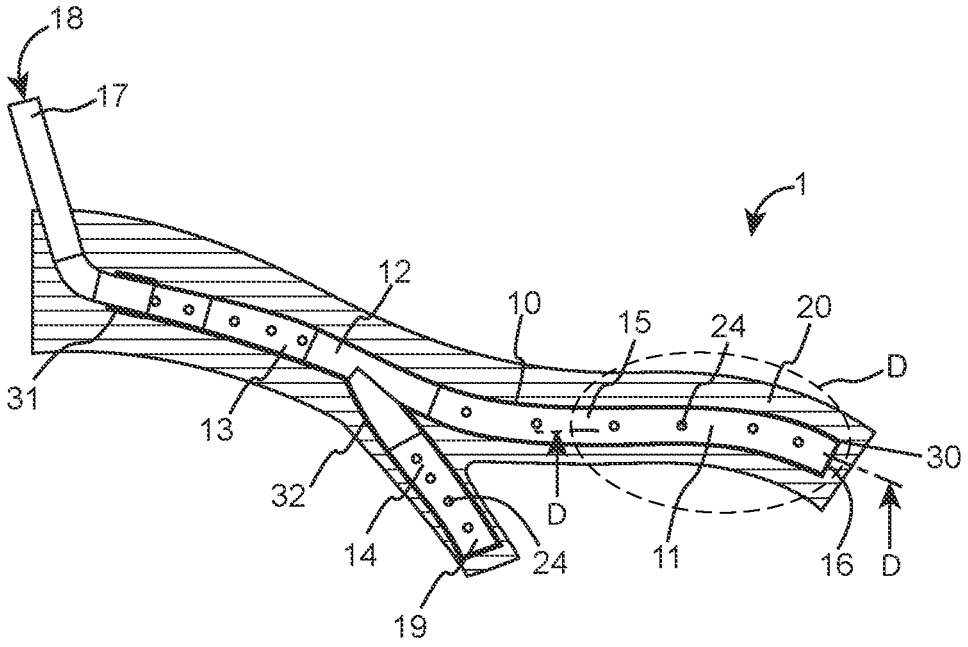
FIG. 1C is a schematic longitudinal cross-sectional view of the log-like block shown in FIGS. 1A and 1B, taken along the plane C-C in FIG. 1B.

As shown in FIG. 1C, the log-like block 1 has a lengthwise passage 30 and a pipe 10, a majority of which is disposed within the passage 30. The passage 30 within the log-like block comprises a passage main portion 31 encapsulating a pipe main portion 13, and a passage branch portion 32 extending transversely from the passage main portion 31 and encapsulating a pipe branch portion 14. Alternatively, a log-like block according to the presently disclosed subject matter can have a plurality of passage branch portions with the corresponding pipe branch portions, which can extend from the passage main portion. The shape and dimensions of the passage main portion 31 and the passage branch portion 32 are in full correspondence with those of the pipe main portion 13 and branch portion 14, respectively, so that the latter are fully encapsulated by the former without a possibility of moving therein.

In another example of a log-like block, not shown in the figures, the block body can have any shape other than elongated shape, having an elongated straight or curved passage therein.

The main and branch portions of the pipe 10 can be made of a flexible material along at least a part of their lengths, allowing the pipe, in spite of its being built-in the block body, to have a curvilinear configuration at least along a part of its extension within the block body 20. In fact, the entire main and branch portions can be made of a flexible material, or at least a majority thereof except for junction/s between the main and branch portions and/or except for those areas, whose rigidity might be specifically desired. Such areas can be those having additional functions such as, for example, constituting a junction between the main and branch portions of the pipe and/or constituting a part protruding from the block body and used for communication of the pipe with an external gas supply source and/or for mounting the log-like block to some support surface of a gas burner. Thus, in the present example, the pipe 10 has a rigid junction 12 and a rigid pipe proximal part 17.

The pipe 10 can be a single continuous body or can comprise a plurality of pipe fittings used to connect different portions of the pipe. Both flexible and rigid portions of the pipe 10 can be made up of heat resistant materials.

The proximal part 17 of the pipe 10 mentioned above protrudes from the block body 20, though a majority of the pipe is fully disposed within the block body 20 and this majority of the pipe disposed within the block body 20 will hereinafter be referred to as a pipe distal part 15. In the present example, the pipe distal part 15 comprises the main and branch pipe portions 13 and 14, each associated with a distal end 16, 19, respectively, which is closed inside the block body 20. The pipe proximal part 17 is associated with a pipe proximal end 18, via which gas communication can be provided between the pipe 10 and an external gas supply unit (not shown).

The pipe 10 is so built in the block body 20 that a circumferential surface of the pipe distal part 15 is in intimate contact with an inner surface of the passage 30 along the entire length of the pipe distal part, by virtue of which the pipe distal part 15 is unable to be moved relative to the passage 30. The pipe distal part 15 is downstream of the pipe proximal part 17 such that the gas which enters the pipe 10 longitudinally from the pipe proximal end 18, flows from the pipe proximal part 17 to the pipe distal part 15.

Figure 1D:
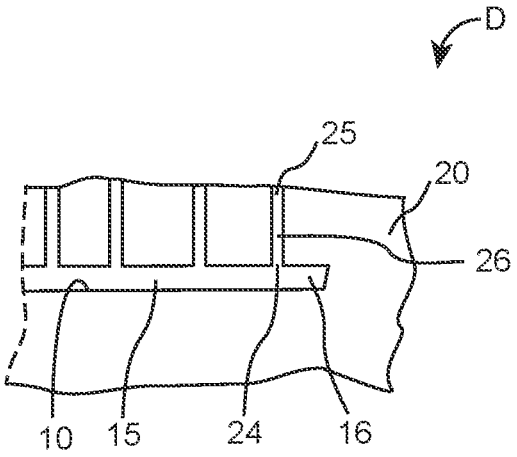
FIG. 1D is schematic cross-sectional view of a portion D of the log-like block shown in FIGS. 1A to 1C, taken along a plane D-D in FIG. 1C.

Referring to FIGS. 1A, 1C and 1D, a plurality of pipe outlet openings 24 are formed in the pipe distal part 15, both in its main and branch portions 13 and 14. In the present example, the pipe outlet openings 24 are formed in the flexible areas of the pipe distal part 15, i.e. areas other than the rigid junction 12 between the pipe main portion 13 and pipe branch portion 14 and a portion of the rigid pipe proximal part 17 disposed within the block body 20.

Referring to FIG. 1D, the block body 20 is formed with a plurality of channels 26 aligned with the pipe outlet openings 24 so as to allow exposure of the openings 24 therethrough to the exterior of the block body 20 and the egress of gas from the pipe through the pipe outlet openings 24 and further through the channels 26 to the exterior of the block body 20. The cross-sectional shape and dimensions of the channels 26 can be the same or similar to those of the pipe outlet openings 24 of the pipe distal part 15.

One or more of the pipe outlet openings can have a shape and dimensions different from those shown in the drawings. For example, this shape can be elongated, i.e. one or more opening can extend along a section of the associated pipe distal part or a majority thereof. In this case the block body can still be formed with plurality of channels. Alternatively, the or each elongated opening can be provided with a single elongated channel in the block body aligned therewith.

In operation of the log-like block shown in FIGS. 1A to 1D, gas supplied to the pipe 10 through the proximal end 18 thereof passes through the pipe proximal part 17 into the pipe distal part 15 and egresses therefrom through the pipe outlet openings 24 and channels 26 into the exterior of the block body 20.

The log body 20 can be generally made of any heat resistant material known in the art, allowing its production by such processes as e.g. molding, casting or extrusion.

In the present example, the block body 20 can be produced from a rigidifyable ceramic or refractory material by a method comprising molding the block body 20 on the pipe 10. More particularly, once the pipe 10 has been provided, it is so placed relative to a mold (not shown) that the pipe distal part 15 and a portion of its proximal part 17 are disposed within the mold whilst the remainder of the pipe proximal part 17 protrudes out of the mold. A rigidifyable material in a molten or liquefied state is then poured into the mold in such a manner that it completely surrounds the pipe distal part 15 with the pipe distal ends 16 and 19 and a portion of the pipe proximal part 17 that does not protrude from the mold. The molten or liquefied rigidifyable material within the mold is then allowed to rigidify. The rigidification of the molten material within the mold will result in the formation of the block body 20 with the pipe 10 being in built-in configuration inside the block body 20 with a portion of the proximal part 17 of the pipe 10 protruding out from the block body 20. With such built-in configuration of the pipe 10 within the block body 20, it has no ability whatsoever of being moved relative to the block body 20, with the pipe distal ends 16 and 19 being closed therein.

Once the molten rigidifyable material has been rigidified around the pipe 10 to achieve required hardness and firmness, the log-like block 1 casting is removed from the mold, and the pipe outlet openings 24 are formed in the pipe distal part 15 simultaneously with the channels 26. This can be done by any suitable cutting operation through the block body 20. In the example of FIGS. 1A to 1D, where the openings are in the form of small round holes, such cutting operation can be e.g. drilling or punching. In case, the opening/s and the corresponding channel/s is/are elongated, they can be formed e.g. by sawing.

In another example, the pipe 10 can have pre-formed opening/s and the mold can comprise insert/s insertable into the opening/s and corresponding in shape and dimensions to the channel/s to be formed in the block body. In this case the rigidifyable material in a molten or liquefied state is poured into the mold once the pipe has been placed in the mold with the insert/s inserted in the pre-formed openings.

The log-like block 1, as produced, can be subjected to any suitable machining to achieve a desirable shape and design.

The above manner of production of log-like blocks of the presently disclosed subject matter, particularly, forming the log body 20 on the pipe 10 for it to be built-in in the corresponding internal passages 30 within the block body 20, allows to avoid any risk that during the formation of the pipe outlet openings as described above, the pipe will be moved relative to the block body.

Furthermore, the above manner of production allows the pipe 10 within the log-like block, particularly, its distal portion 15, to have curved or non-straight portions since these can be made up of a flexible material.

The block body 20 can be produced with one or more elongated grooves aligned with, and repeating the general configuration of, the built-in parts of the pipe 10 disposed within the block body 20.

Such grooves can be used for placing therein various lightweight low thermal mass materials such as metal wool and/or metal dust and/or other non-combustible materials and/or non-degradable material to improve the glow of the flames. Such materials can have a good heat retention property and due to their low thermal mass, when the combustible flames contact them an aesthetically pleasing glowing/shimmering effect can be achieved which resembles the glowing embers. The overall effect of metal wool and/or metal dust is to enhance the natural, aesthetic appearance of the log-like block 1 in a fireplace, e.g. such as the fireplace 50 shown in FIG. 3. The non-degradable low thermal mass materials such as metal wool can be made of materials such as, but not limited to, nickel or nickel chrome.

Additionally or alternatively, the grooves mentioned above can be used for forming the pipe outlet openings 24 therethrough at different areas thereof corresponding to the associated flexible portions of the pipe distal part 15.

Figure 4:
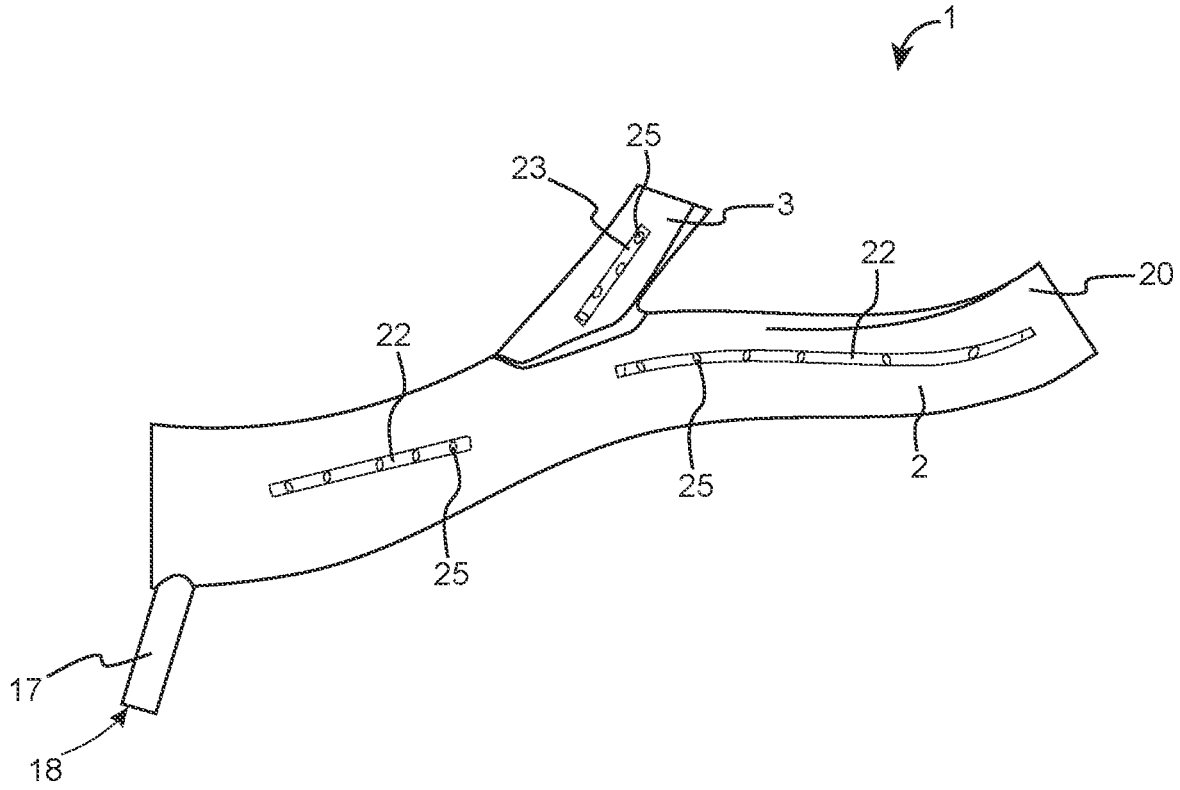
FIG. 4 is a schematic plan view of a log-like block according to still further example of the presently disclosed subject matter.

One example of a log-like block with such grooves is shown in FIG. 4, where the log-like block 1 is substantially the same as that shown in FIG. 1A with the only differences being in that its block body 20 has elongated grooves 22 formed in the main portion 2 and an elongated groove 23 formed in the branch portion 3 of the log-like block 1 of FIG. 4, and in that instead of the channels 26 of the log-like block 1 of FIG. 1A, the log-like block of FIG. 4 has groove openings 25 within the grooves 22 and 23, which similarly to the channels 26 are aligned with the pipe outlet openings 24. The size of the groove openings 25 can be identical or similar to the size of the pipe outlet openings 24.

The groove openings 25 thus have the same function as the channels 26 in the block body 20 of the log-like block of FIG. 1A, namely to allow exposure therethrough of the pipe outlet openings 24 to the exterior of the log-like block 1.

Operation of the log-like block 1 shown in FIG. 4 is the same as that of the log-like block 1 of FIGS. 1A to 1D, with the only difference being in that gas disposed in the pipe distal part 15 egresses therefrom into the exterior of the block 1 through the pipe outlet openings 24 and groove openings 25.

To form the grooves 22 and 23 in the block body 20 of the log-like block 1 of FIG. 4, the shape of the mold used to cast the block body 20 should have corresponding protrusions, notches, craters, cutters or the like.

Referring now to FIG. 3, there is illustrated one example of a decorative fireplace 50 with a gas burner (not seen), in which log-like blocks can be used, in accordance with the presently disclosed subject matter, such as the blocks 1 described above. The fireplace 50 comprises an interior 52 constituting a concealed space, which is used to accommodate therein the gas burner and one or more log-like blocks e.g. such as the log-like blocks 1 described above.

Figure 2:
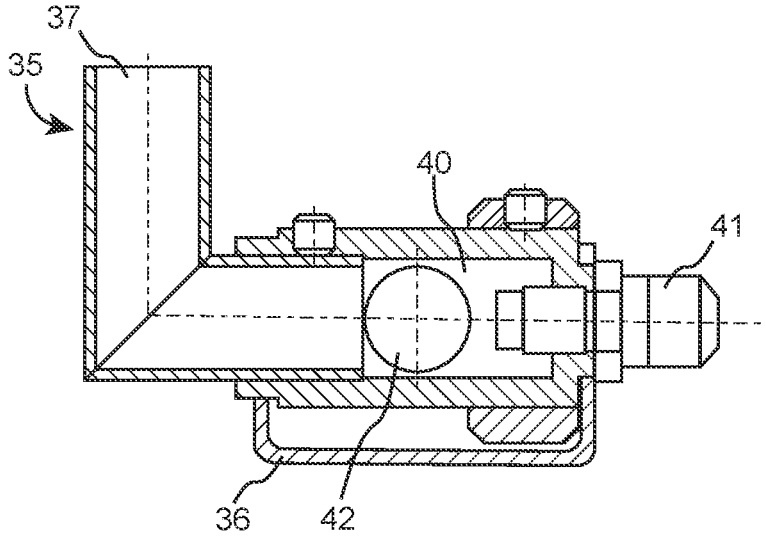
FIG. 2 is a cross-sectional view of a holder that can be used for mounting a log-like block in a gas burner according to another example of the presently disclosed subject matter.

Referring to FIG. 2, in order to facilitate mounting of a log-like block in accordance with the presently disclosed subject matter, in a gas burner (not shown) of a fireplace, it can comprise a holder 35 having a holder base 36 and configured to be placed within the interior 52 of the fireplace 50 so that its base 36 is fixed to the fireplace body or to other element of the fireplace using fixation means (not shown). The fixation means can be configured to provide a secure connection of the holder 35 to the interior 52 of the fireplace 50. The fixation means used for securing the holder 35 can have any suitable design and, for example, can comprise a locking bracket, set of screws, hinges, or other fastening arrangement.

The holder 35 shown in FIG. 2 has a gas outlet port 37 configured to fixedly and detachably hold a log-like block according to the presently disclosed subject matter, by receiving within the gas outlet port 37, the pipe proximal part 17 with its end 18 protruding from the log-like block 1. The orientation of the log-like block 1 while being connected to the holder 35 can be adjusted during the installation of the log-like block 1 in the gas burner (not shown). The gas outlet port 37 is designed to allow convenient mating with the pipe proximal end 18 of the pipe proximal part 17. The size of the gas outlet port 37 should conform to the dimensions of the pipe proximal end 18 of the pipe proximal part 17 so that a substantially airtight channel of the pipe proximal part 17 with the gas supply unit (not shown) can be achieved via the holder 35. The connection between the gas outlet port 37 and the pipe proximal end 18 of the pipe proximal part 17 can be a threaded connection, a snap fit arrangement or any other type of joint which prevents any leakage of the gas.

The holder 35 further comprises an aeration chamber 40 having a gas inlet port 41 and an air inlet port 42. The gas inlet port 41 is connectable to an external gas supply unit (not shown), so as to supply combustible gas into the aeration chamber 40 while the air inlet port 42 is in gas communication with the interior 52 of the fireplace 50 to allow access of the air to the aeration chamber 40, the arrangement being such as to allow the combustible gas mixing with the air in the aeration chamber 40. Alternatively, the air inlet port 42 can be in gas communication with outside the fireplace 50 to allow air therefrom to be supplied into the aeration chamber 40.

Optionally, the air inlet port 42 can comprise an air input valve (not shown) configured for adjusting the amount of air accessing the aeration chamber 40. The air input valve can be opened or closed to control the amount of air entering the aeration chamber 40 so as to aid in preparation of an enriched air/gas mixture to be fed to the log-like block 1 to be supplied through the holder 35 into the pipe 10, and further to be used for combustion in the fireplace. Optionally, the air input valve can be electronically controlled in communication with sensors.

The fireplace 50 can be operated as any conventional fireplace having a gas burner with one or more log-like blocks.

REFERENCE NUMERALS USED IN THE ABOVE DESCRIPTION AND THE ACCOMPANYING DRAWINGS

1—log-like block
2—main portion of the log-like block
3—branch portion of the log-like block
10—pipe
12—pipe rigid portions
13—pipe main portion
14—pipe branch portion
15—pipe distal part
16—pipe distal end of the main pipe portion
17—pipe proximal part
18—pipe proximal end
19—pipe distal end of the branch pipe portion
20—block body
22—grooves on the main portion of the log-like block
23—grooves on the branch portion of the log-like block
24—pipe outlet openings
25—groove openings
26—channels
30—passage
31—passage main portion
32—passage branch portion
35—holder
36—holder base
37—gas outlet port
40—aeration chamber
41—gas inlet port
42—air inlet port

50—fireplace
52—interior

The invention claimed is:

1. A gas burner for a fireplace, the gas burner comprising: at least one log-like block comprising:

a pipe having a pipe distal part made at least in part of a flexible material and associated with at least one distal end of the pipe, and a pipe proximal part associated with a proximal end of the pipe;

a block body having a passage with a passage shape and dimensions corresponding to those of the pipe distal part, the pipe distal part being built-in in said passage so that the at least one pipe distal end is closed therein and the pipe distal part is free of a capability of being moved relative to the passage, the pipe proximal part with the proximal end of the pipe being configured to be brought into a gas communication with a gas supply source;

at least one pipe outlet opening having an elongated shape, formed in the pipe distal part, and exposed to an exterior of the block through a channel formed in the block body aligned with the at least one outlet so as to allow a gas within the pipe to exit the pipe distal part through said opening to the exterior of the block body; and a holder configured to detachably hold the log-like block in a desired orientation in an interior of the fireplace and to establish the gas communication between the pipe and the gas supply source the holder comprising a gas outlet port having inner dimensions conforming to outer dimensions of the proximal part of the pipe and configured to receive therein the proximal part of the pipe to provide an airtight channel for said gas communication.

2. The gas burner according to claim 1, wherein an orientation, in which the holder holds the log-like block, is adjustable at least during installation of the gas burner.

3. The gas burner according to claim 1, further comprising an aeration chamber disposed within the holder, and configured to be brought in gas communication with the gas source to allow gas flow into the aeration chamber and with the interior of the fireplace to allow access of air to the chamber for aeration of the gas, and an air input valve configured for adjusting the amount of air accessing the aeration chamber.

4. The gas burner according to claim 1, wherein the at least one pipe outlet extends along a majority of the section associated with the pipe distal part.

5. The gas burner according to claim 1, wherein said channel has cross sectional shape and dimensions similar to those of the at least one outlet.

6. The gas burner according to claim 1, wherein said channel has cross sectional shape and dimensions identical to those of the at least one outlet.

7. The gas burner according to claim 1, further comprising configured to fix the holder to the interior of the fireplace.

* * * * *